US005431461A

United States Patent [19]

Andersen, III et al.

[11] Patent Number: 5,431,461

[45] Date of Patent: Jul. 11, 1995

[54] SLIDING WINDOW LOCK FOR AUTOMOTIVE VEHICLES

[76] Inventors: Edward W. Andersen, III, 9429 Roslyndale Ave., Arleta, Calif. 91331; Dikran Shirinian, 6336 Belaire Ave., North Hollywood, Calif. 91606

[21] Appl. No.: 186,987

[22] Filed: Jan. 28, 1994

[51] Int. Cl.[6] ..... E05C 17/30

[52] U.S. Cl. ..... 292/259; 292/288; 292/262

[58] Field of Search ..... 292/259, 288, 289, 339, 292/262, 5, DIG. 46, 302

[56] References Cited

U.S. PATENT DOCUMENTS

| | | | |
|---|---|---|---|
| 837,595 | 12/1906 | Storr | 292/339 |
| 3,606,421 | 5/1970 | Reichenbach | 292/288 |
| 3,615,114 | 10/1969 | Harris | 292/288 |
| 4,105,233 | 8/1978 | Levey | 292/288 |
| 4,846,513 | 7/1989 | Mathis, II | 292/262 |
| 4,971,374 | 11/1990 | Lovell et al. | 292/288 |

*Primary Examiner*—Peter M. Cuomo
*Assistant Examiner*—Monica E. Millner

[57] ABSTRACT

A bar (20, 120) includes a first end (22, 122), which is engageable with a window (12,112), and a second end (24, 124) which is engageable with a window guide (16) or another window (114), depending upon whether the bar is used with a single sliding window or two sliding windows. In one configuration (FIGS. 6–9), where both windows can slide, the second end (124) is engageable with a second of the windows. In another configuration (FIGS. 1–5), where only one window can slide, the second end (14) is engageable with a part of the vehicle, specifically, a window guide (16). It is also possible (FIG. 10) to use two bars (20) formed in the configuration where both windows can slide, by placing them respectively between the edges (**112*a*, 114*a*) of windows (112, 114) and the window guides (116). To prevent sliding and opening of one or both windows and thereby to prevent unauthorized entry into the vehicles, an adjusting and locking connection (32,132) enables the ends (22, 122; 24, 124**) to move towards and away from each other, to properly position the bar or bars with respect to the windows and/or the window guides, and then to permit their ends and the window or windows to be locked in a fixed spaced relationship with each other.

8 Claims, 3 Drawing Sheets

SLIDING WINDOW LOCK FOR AUTOMOTIVE VEHICLES

BACKGROUND OF THE INVENTION

1. Field of the Invention

The present invention relates to locking devices for vehicular sliding windows and, in particular, to such devices for locking single and double slide rear windows most commonly found on pick-up trucks.

2. Description of Related Art and Other Considerations

Single and double slide windows on such automotive vehicles as pick-up style trucks are commonly locked by a plastic lock. Such a plastic lock is fragile, and notoriously subject to being broken to permit easy opening of the rear window and entry into the truck's cabin.

SUMMARY OF THE INVENTION

This and other problems are successfully addressed and overcome by the present invention. The present invention comprises a bar having a first end, which is engageable with a window, and a second end. In a first configuration, where both windows can slide, the second end is engageable with a second of the windows. In a second configuration, where only one window can slide, the second end is engageable with a part of the vehicle, specifically, a window guide. It is also possible to use two bars formed in the second configuration where both windows can slide, by placing them respectively between the windows and the window guides. To prevent sliding and opening of one or both windows and thereby to prevent unauthorized entry into the vehicles, an adjustable and lockable connection is formed between the bar and one of the ends. This connection enables the ends to move towards and away from each other, to properly position the bar or bars with respect to the windows and/or the window guides, and then to permit the ends to be locked in a fixed spaced relationship with each other. Several advantages are derived from this arrangement. Unauthorized entry into the vehicle cab or interior is prevented in a simple, yet reliable, and inexpensive manner. Special adaptations to the vehicle are avoided. The bars of the present invention can be moved from vehicle to vehicle.

Other aims and advantages, as well as a more complete understanding of the present invention, will appear from the following explanation of exemplary embodiments and the accompanying drawings thereof.

DETAILED DESCRIPTION OF THE PREFERRED EMBODIMENTS

Figure 1:
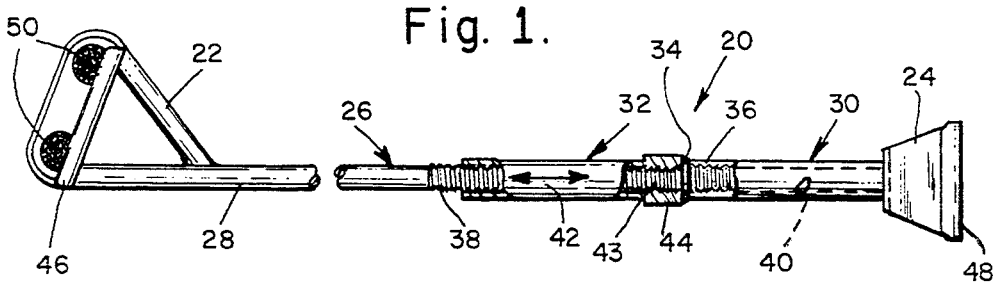
FIG. 1 is a side view of a first embodiment of the present invention.
Figure 2:
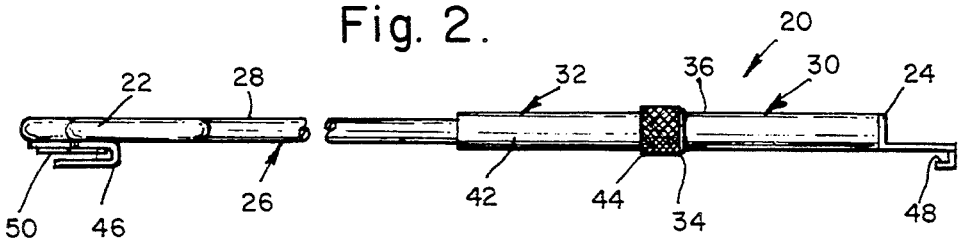
FIG. 2 is a top view of the first embodiment of the present invention depicted in FIG. 1.
Figure 3:
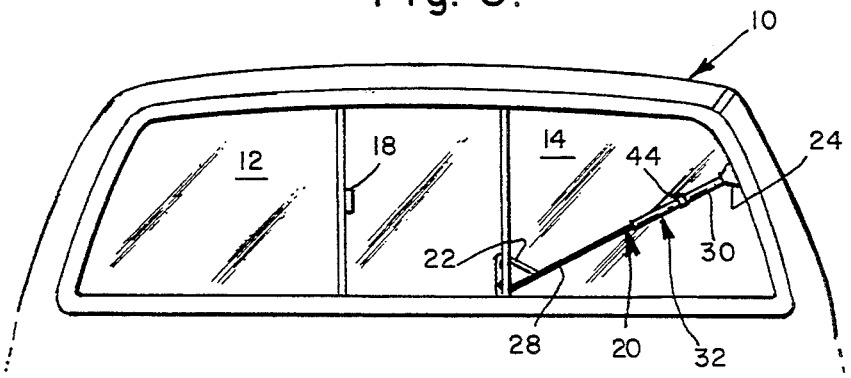
FIG. 3 is view of a rear window assembly in a cab of a pickup truck illustrating the first embodiment in locking position with the window assembly.
Figure 4:
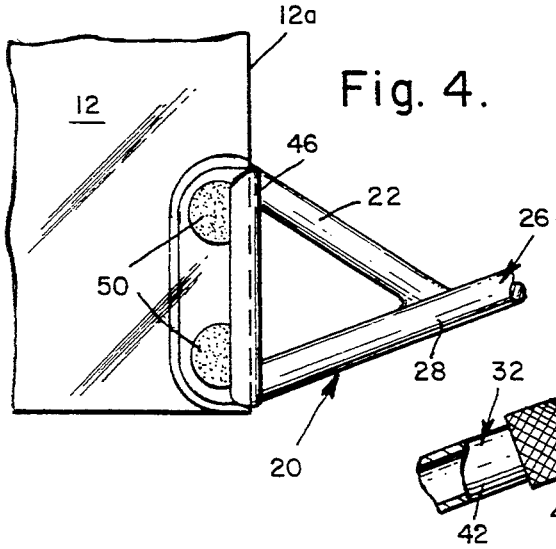
FIGS. 4 and 5 respectively depict the engagement of the ends of the locking bar of the first embodiment respectively with a single movable window and with an opposed window seating, for preventing the window from being opened and the cab compartment from being entered.
Figure 5:
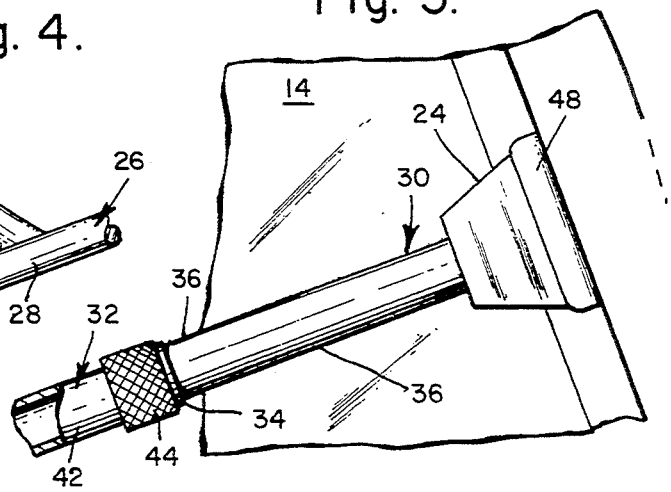
Figure 6:
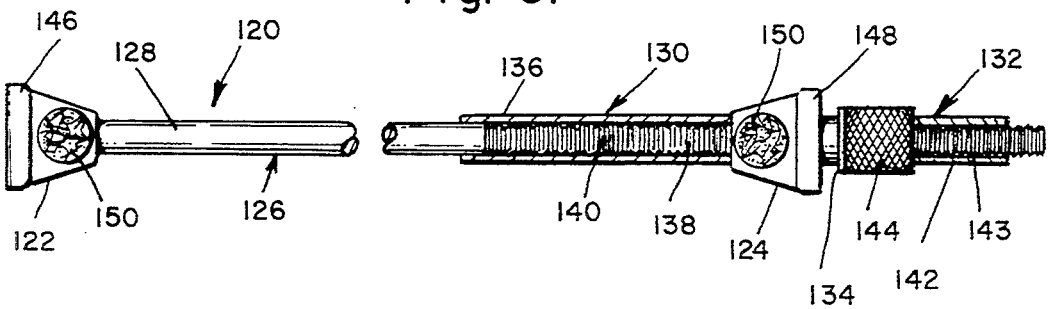
FIG. 6 is a side view of a second embodiment of the present invention.
Figure 7:
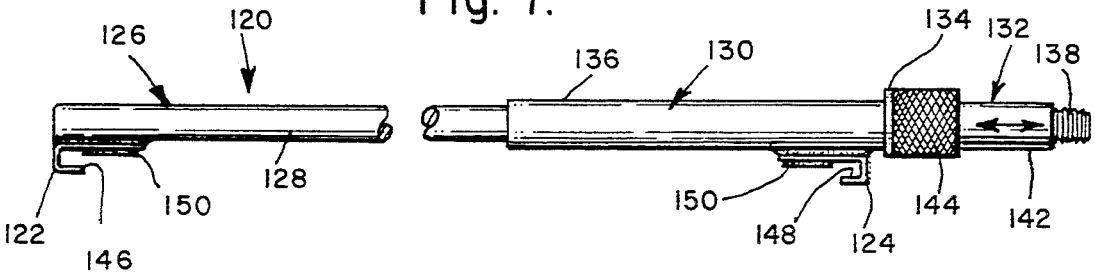
FIG. 7 is a top view of the second embodiment of the present invention depicted in FIG. 6.

Referring to FIGS. 1–5, a pick-up truck 10 is shown having a single slidable window 12 and a fixed window 14 which together form the rear window assembly for the cab or interior passenger compartment of the truck. As is conventional, the windows reside in a guide 16 in which the slidable window can slide and in which the stationary window is fixed. A conventional lock 18, whose window locking use is displaced by that of the present invention, is also shown in FIG. 3.

In the first embodiment illustrated in FIGS. 1–5, for use with pick-up truck single sliding window, a locking bar 20 comprises a first portion 26 having a first end 22, a second portion 30 having a second end 24, and an internally threaded tubular adjusting and locking connection 32.

First portion 26 includes a shaft 28 integrated with first bar end 22. Second portion 30 includes a tubular end 36 integrated with second bar end 24. Shaft 28 terminates in a threaded cylindrical end 38. Tubular end 36 has a smooth internal bore 40. Connection 32 includes a sleeve 42 having a knurled surface and a threaded bore preferably within the knurled surface part. The threaded bore of sleeve 42 engages cylindrical end 38 of shaft 28. First and second ends 22 and 24 of locking bar 20 are arranged for movement respectively towards and away from one another and for respective turning movement. Threaded sleeve 42, when threaded onto shaft 28, is disposed to abut tubular end 36 through a washer 34, and places first and second ends 22 and 24 in a fixed spaced relationship with one another.

Both first and second ends 22 and 24 are provided with U-shaped channels 46 and 48. U-shaped channel 46 is internally configured to fit about an end edge 12*a* of slidable window 12, while U-shaped channel 48 is externally configured to fit within window guide 16. Felt pieces 50 are applied to the inside surfaces of U-shaped channel 46 both to provide a tight engagement with window 12 and to prevent it from being scratched.

In operation, when it is desired to lock windows 12 and 14 together and to secure the cab from unauthorized entry, window 12 is first closed. Internally threaded sleeve 42 of locking bar 20 when threaded back on threaded end 38 of shaft 28, permits tubular end 36 of tube 30 to move towards first bar end 22 and, therefore permits first and second bar ends 22 and 24 to be moved towards one another. The locking bar can then be placed in its window-locking position. To this end, tube 30 is turned so as to position its U-shaped channel 48 into window guide 16, and U-shaped channel 46 is fitted about edge 12*a* of slidable window 12. Sleeve 42 is then screwed in a reverse direction on shaft 28 towards and into firm contact with tubular end 36. This firm contact provides the locking of bar 20 into position, as shown in FIG. 3.

Figure 8:
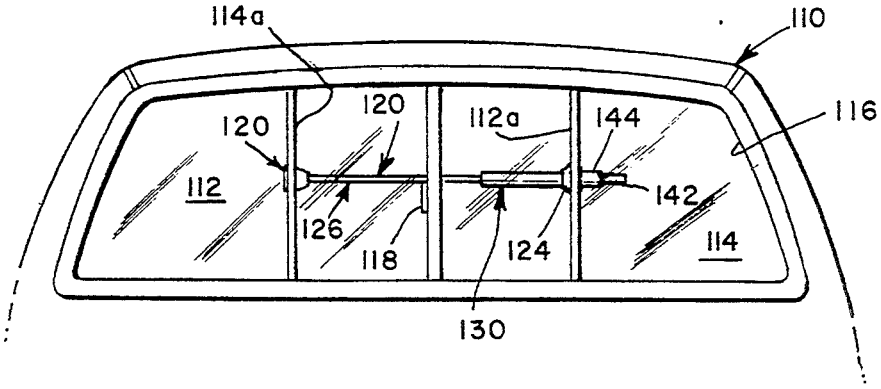
FIGS. 8 and 9 respectively depict the engagement of the opposite ends of the locking bar of the second embodiment with a pair of movable windows, for preventing the windows from their being opened and the cab compartment from being entered.
Figure 9:
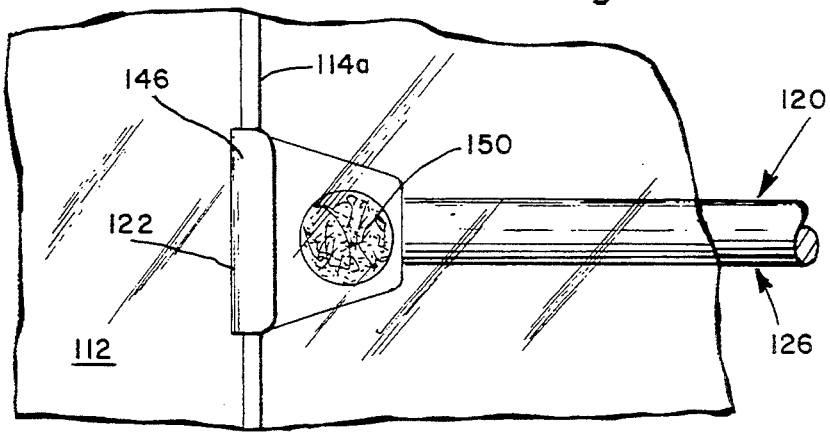

Referring now to FIGS. 6–9, a pick-up truck 110 is shown having a pair of slidable windows 112 and 114 which together form the rear window assembly for the cab or interior passenger compartment of the truck. As is conventional, the windows reside in a guides 116 in which the slidable windows can slide. A conventional lock 118, whose window locking use is displaced by that of the present invention, is also shown in FIG. 8.

In the second embodiment illustrated in FIGS. 6–9, for use with pick-up truck double sliding window, a locking bar 120 comprises a first portion 126 having a first end 122, a second portion 130 having a second end 124 and adjustable and lockable connectors 132.

First portion 126 includes a shaft 128, which is integrated with first bar end 122 which is externally threaded. Second portion 130 includes a tube 136 secured to second end 124. Tube 136 has a smooth bore 140. Connection 132 includes a sleeve 142 having a knurled portion 144 which is internally threaded to engage threads 138 on shaft 128. First and second ends 122 and 124 of locking bar 120 are arranged for movement respectively towards and away from one another and for respective pivotal movement. Internally threaded sleeve 142, as aided by knurled knob 144, through its threaded engagement with external threads 138 is disposed to abut tubular end 136 through a washer 134, and places first and second ends 122 and 124 in a fixed spaced relationship with one another.

Both first and second ends 122 and 124 are provided with U-shaped channels 146 and 148. U-shaped channel 146 is internally configured to fit about an end edge 112*a* of slidable window 112, while U-shaped channel 148 is internally configured to fit about and end edge 114*a* of window 114. Felt pieces 150 are applied to the inside surfaces of U-shaped channels 146 and 148 both to provide a tight engagement with windows 112 and 114 and to prevent them from being scratched.

In operation, when it is desired to lock windows 112 and 114 together and to secure the cab from unauthorized entry, windows 112 and 114 are first closed. Internally threaded sleeve 142 is threaded back from shaft 128 to permit first and second bar ends 122 and 124 to be moved away from one another and to permit the locking bar to be placed in its window-locking position. To this end, shaft 130 swivelled about shaft 128 and its U-shaped channel 148 is placed about edge 114*a* of window 114, and U-shaped channel 146 is fitted about edge 112*a* of slidable window 112. Sleeve 142 is then turned with respect to shaft 128 and thus threaded towards and into firm contact with tubular end 136. This firm contact places bar 120 into its locked position, as shown in FIG. 8.

Figure 10:
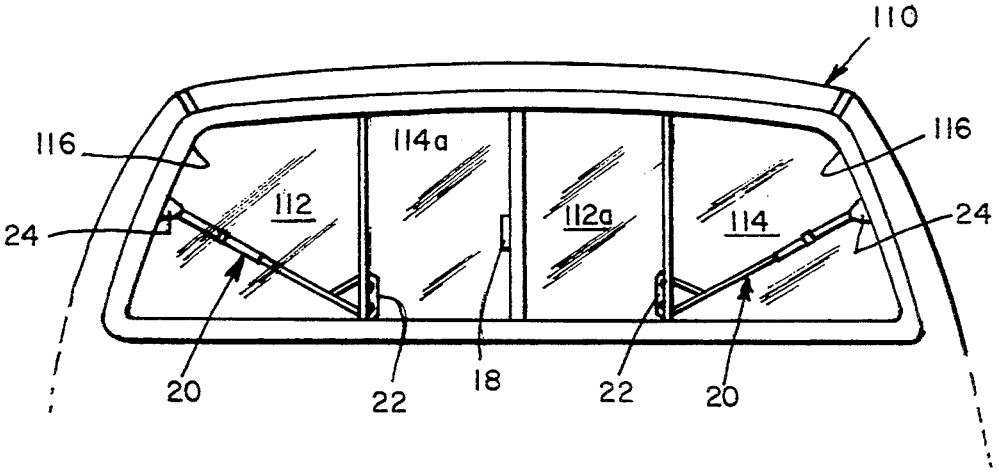
FIG. 10 depicts a further modification utilizing a pair of locking bars depicted in FIGS. 1–5 for use with the double sliding windows depicted in FIG. 8.

As a further modification, as depicted in FIG. 10, a pair of locking bars 20, such as shown in FIGS. 1–5, may be used with the double sliding window arrangement illustrated in FIGS. 6–9. Here, instead of using locking bar 120 and its contacts with window edges 112*a* and 114*a*, respective locking bars 20 are positioned in a manner as that described with respect to FIGS. 1–5. Specifically, U-shaped channels 46 of each of their first ends 22 are fitted into engagement with edges 112*b* and 114*b* of windows 112 and 114. In a like manner, U-shaped channels 148 of second ends 24 are fitted within opposing window guides 116. Threaded tightening of internally threaded sleeves 42 lock the windows in their mutually closed positions.

Although the invention has been described with respect to particular embodiments thereof, it should be realized that various changes and modifications may be made therein without departing from the spirit and scope of the invention.

What is claimed is:

1. A lock for preventing one or more slidable windows of automotive vehicles from being opened and for preventing unauthorized entry into the vehicles, comprising:

a bar;

a first end on said bar having a U-shaped channel which is adapted to engage a first of said windows at its edge;

a second end on said bar for alternate engagement of a second of said windows and a part of the vehicle; and an adjustable and lockable connection between said first and second ends for enabling movement of said ends towards and away from each other and for locking said ends in a fixed spaced relationship with each other.

2. A lock according to claim 1 in which said adjustable and lockable connection comprises a thread on said bar and a nut threadedly engaged therewith and abuttable against one of said bar ends.

3. A lock according to claim 1 in which said first and second windows are slidable relative to one another, and in which said second bar end comprises a U-shaped channel which is adapted to engage said second window at its edge, said bar ends, when engaged with their respective window edges and fixed in position with respect to said first bar end by said adjustable and lockable connection, are locked in the fixed spaced relationship with each other and lock and prevent said windows from mutual movement with respect to one another and thereby from being opened.

4. A lock according to claim 3 in which said adjustable and lockable connection comprises a thread on said bar and a nut threadedly engaged therewith and abuttable against one of said bar ends.

5. A lock according to claim 1 in which:

said second window is fixed with respect to said first window, and said first window is slidable with respect to said second window; and said second bar end is adapted to engage said vehicle part, said first and second bar ends, when engaged with their respective window edge and vehicle part and fixed in position by said adjustable and lockable connection, are locked in the fixed spaced relationship with each other and prevent said first window from being opened.

6. A lock according to claim 5 in which said vehicle part comprises a guide for guiding said second window, and said second bar end is configured to fit within and be received by said guide.

7. A lock according to claim 6 in which said adjustable and lockable connection includes means for enabling movement of said ends towards and away from each other and for locking said ends in a fixed spaced relationship with each other.

8. A lock according to claim 6 in which said bar end comprises a U-shaped channel which is optionally adapted to receive and engage said second window at its edge.

* * * * *